US005871143A

United States Patent [19]

Nestler et al.

[11] Patent Number: 5,871,143

[45] Date of Patent: Feb. 16, 1999

[54] DECORATIVE CARDBOARD HOLLOW SHELL

[76] Inventors: Ursula Nestler, Annaberger Str. 59c; Jochen Nestler, Strasse der Freundschaft 18b; Andreas Nestler, Dr.-Otto-Nuschke-Strasse 52c, all of 09488 Wiesa, Germany

[21] Appl. No.: 892,037

[22] Filed: Jul. 14, 1997

Related U.S. Application Data

[63] Continuation-in-part of PCT/DE95/01850, Dec. 19, 1995.

[30] Foreign Application Priority Data

Jan. 22, 1995 [DE] Germany ..... 295 00 768 U

[51] Int. Cl.[6] ..... B65D 3/22

[52] U.S. Cl. ..... 229/4.5; 229/116.5; 229/125.19; 229/406; 229/922

[58] Field of Search ..... 229/4.5, 5.81, 229/5.83, 5.84, 116.1, 116.2, 116.5, 125.19, 406, 922; 206/457

[56] References Cited

U.S. PATENT DOCUMENTS

| | | | |
|---|---|---|---|
| 90,107 | 5/1869 | Kimball | 229/4.5 |
| 265,836 | 10/1882 | Lindner | 229/4.5 |
| 2,082,614 | 6/1937 | Brodrick | 229/4.5 |
| 2,728,513 | 12/1955 | Damant et al. | 229/125.19 |
| 2,822,970 | 2/1958 | Froggatt et al. | 229/116.5 |
| 2,849,170 | 8/1958 | Roos et al. | 229/125.19 |
| 5,383,595 | 1/1995 | Hallam | 229/116.1 |

*Primary Examiner*—Gary E. Elkins
*Attorney, Agent, or Firm*—Klaus J. Bach

[57] ABSTRACT

The invention pertains to a decorative cardboard hollow shell to be filled with gifts such as Easter eggs, hearts, gift boxes, imitation fruit and the like, decorated outside and/or inside with pictorial elements and consisting of two half-shells with cuved surfaces. The half-shells have circumferential edges to which a non-pre-formed coatings are applied to form rim coatings that produces an inside and outside edge strip covering all rough transitions and cut edges of each cardboard hollow shell half, this rim coating forming a clean and decorative surface.

2 Claims, 1 Drawing Sheet

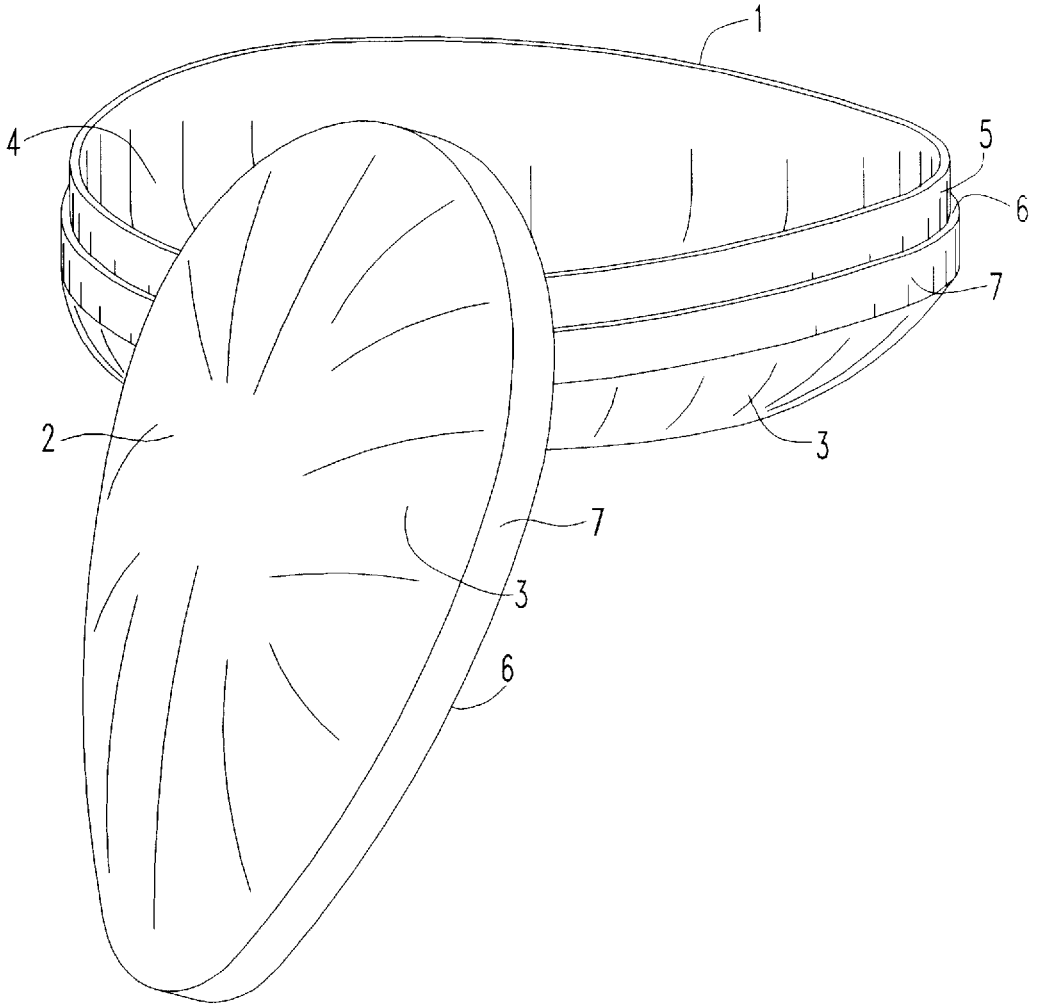
1
4
5
6
7
2
3
7
3
6

DECORATIVE CARDBOARD HOLLOW SHELL

This is a Continuation-In-Part application of international patent application PCT/DE95/01850 filed Dec. 19, 1995 and claiming priority of German patent application 29 50 0768.0 filed Jan. 22, 1995.

BACKGROUND OF THE INVENTION

The invention relates to a decorative cardboard hollow shell which is to be filled with gifts such as Easter eggs, hearts, gift boxes, imitation fruits and the like, and which is decorated outside and/or inside with pictorial elements. It consists of two half-shells with curved surfaces. Only one shell half may be used for the open presentation of the gifts, in particular, for exhibition purposes.

Such decorative cardboard hollow shells are available in various design. However, they all have one basic form, which is due in part to manufacturing technology. The cardboard hollow shells to be filled consist of two evenly or nearly evenly dimensioned halves, whereby the half serving as the bottom is provided with a cardboard strip (neck) on its inside for holding the upper half (cover) in position. The bottom can also be flattened to provide better support. The cover half may also have decorative elements similar to those provided on the bottom half. The distinctive feature of the decorative cardboard hollow shells is their outer structure. This is achieved by mounting printed motifs to the outside. However, at the circumferential edges the cardboard hollow shell halves do not form clean edges, despite being cut later in the manufacturing process. This edge is therefore covered by a paper border strip which, at the same time, forms part of the decoration. The paper border strip covers both the edge itself and an approximately 1–2 cm wide area inside and outside of the shell adjacent the edge. However, applying the paper border strip requires time-consuming and costly manual labor taking up 30–40% of the total time required for manufacturing the product (depending on the dimensions of the product).

It is the object of the present invention to provide a decorative cardboard hollow shell of the type described, wherein the need for applying a paper border strip at the cut edge of the shell, and thus the costly and time-consuming manual labor, is eliminated without sacrificing the appearance and the various design possibilities for the shell.

SUMMARY OF THE INVENTION

The invention resides in a decorative cardboard hollow shell to be filled with gifts such as Easter eggs, hearts, gift boxes, imitation fruit and the like, decorated outside and/or inside with pictorial elements and consisting of two half-shells with folded surfaces. The object is to devise a decorative cardboard hollow shell such that ther is no need for mounting a paper border strip over the cut edge of the shell, so that the costly and time-consuming manual labor required herefor is eliminated, without sacrificing the various design possibilities inside and out. This is accomplished by applying a non-pre-formed coating substance to form a rim coating that produces an inside and outside edge strip covering rough transitions and cut edges of each cardboard shell half, the rim coating providing for a clean and decorative surface.

An embodiment of the invention is described by way of an example on the basis of the accompanying drawing.

BRIEF DESCRIPTION OF THE DRAWINGS

The sole figure shows the preferred implementation for a hollow shell according to the invention, which is a cardboard egg having a bottom and a removable cover.

DESCRIPTION OF THE PREFERRED EMBODIMENT

For better understanding, the following terms as used in the description are explained below:

| | |
|---|---|
| Printed sheet | paper or cardboard sheet with motifs printed on it |
| Ronde | punched-out cardboard disks each consisting of printed sheet, glue, and cardboard with motifs printed on its inside, or unprinted |
| Shell with Rim | shell whose cut edges have been immersed into a coating substance providing a coating covering the rough areas of the edges and to decorate the cardboard shell. |

As shown in the figure, the hollow shell comprises a cardboard egg including a bottom shell 1 and a cover shell 2. The outer surfaces 3 of both the bottom and cover shells are decorated with pictorial elements to provide for an attractive gift box when the cover shell 2 is placed onto the bottom shell 1. Gifts such as candies may be placed into the inside 4 of the hollow shell 1,2. The shell halves 1, 2, which are cut along their circumferential edges 6, are provided with a coating rim 7 to cover the rough-cut circumferential edge 6. A cardboard strip 5 is disposed around the inner circumference of the bottom shell 1 and projects therefrom to engage the top shell 2 and properly retain it when it is placed onto the bottom shell.

To make the hollow egg shells, first, a printed sheet and cardboard of different weights are bonded together. Because the cardboard will later form the inside of the decorative cardboard egg, it can (not must) already be imprinted with the motifs to be displayed on the inside of the egg shell halves. The second processing step is to punch out the rondes around the motifs on the printed sheet. Next, the rondes are formed in presses including special tools into shells—the future cardboard egg shell halves. These shells are cut at their edges. Up to this point, the manufacturing technology remains unchanged.

Now, instead of applying a paper strip to cover the blemishes of the cut edge, a liquid coating is applied inside and outside the cut edges. For this purpose, each cardboard egg shell half is preferably immersed with its edge portion at least once into a liquid coating substance so that an approximate 1–12 mm wide coating rim is applied inside and outside the cut edges, covering all rough spots resulting from cutting. However other liquid coating application technologies, such as spraying, may be used. Only one operation is necessary and the coating may provide for the final coloring and final decorative shape of the coating rim. However, by repeating the original application procedure, or by using another known application method, the preferably still moist coating rim can be processed further for decorative purposes. For example, an additional flake coating or color effects can be applied. A neck (cardboard strip) is inserted into the cardboard egg halves which serve as the bottoms. An optional second decorative coating is then applied to the outside and/or inside of the coating rim.

What is claimed is:

1. A decorative cardboard hollow curved shell consisting of two essentially evenly dimensioned halves formed by pressing from originally flat rondes of cardboard and provided, at least on the outside, with a decorative coating of an originally flat paper picture providing, at the circumferences of said shell halves, for rough transitions and cut edges, a coating rim applied to said cut edges which produces an inner and outer edge area covering said rough transitions and cut edges of each cardboard hollow shell half, said coating rim being formed by an application of a liquid coating substance providing the rim coating and, at the same time, forming a clean and decorative surface.

2. A decorative cardboard shell according to claim 1, wherein said rim coating consists of several layers.

* * * * *